US009181701B2

(12) United States Patent
Hofmann

(10) Patent No.: US 9,181,701 B2
(45) Date of Patent: Nov. 10, 2015

(54) METHOD FOR THE PRODUCTION OF A LONGITUDINAL CONNECTION FOR WOODEN COMPONENTS AND CORRESPONDING WOODEN COMPONENT

(76) Inventor: Mathias Hofmann, Weilbach (DE)

( * ) Notice: Subject to any disclaimer, the term of this patent is extended or adjusted under 35 U.S.C. 154(b) by 250 days.

(21) Appl. No.: 12/809,875

(22) PCT Filed: Dec. 18, 2008

(86) PCT No.: PCT/EP2008/010852

§ 371 (c)(1),
(2), (4) Date: Jul. 2, 2010

(87) PCT Pub. No.: WO2009/077192

PCT Pub. Date: Jun. 25, 2009

(65) Prior Publication Data

US 2010/0275551 A1 Nov. 4, 2010

(30) Foreign Application Priority Data

Dec. 19, 2007 (DE) ..... 10 2007 061 318

(51) Int. Cl.
*E04C 3/14* (2006.01)
*E04B 1/26* (2006.01)

(52) U.S. Cl.
CPC ..... *E04C 3/14* (2013.01); *E04B 1/2604* (2013.01); *E04B 2001/264* (2013.01); *E04B 2001/2624* (2013.01); *E04B 2001/2644* (2013.01); *E04B 2001/2692* (2013.01)

(58) Field of Classification Search
CPC ..... E04B 1/2604; E04B 2001/264; E04B 2001/2692; E04B 2001/2632; E04B 2001/2644; E04B 2001/2624; E04B 2001/2628; E04B 2001/2652; E04C 3/14
USPC ..... 52/417, 418, 420, 847; 403/265
See application file for complete search history.

(56) References Cited

U.S. PATENT DOCUMENTS

| | | | | | |
|---|---|---|---|---|---|
| 1,413,395 | A | * | 4/1922 | Donnelly | 403/340 |
| 2,068,098 | A | * | 1/1937 | Elmendorf | 52/448 |
| 3,094,747 | A | * | 6/1963 | Hess | 403/265 |
| 3,830,581 | A | * | 8/1974 | Furlong | 403/340 |
| 3,885,071 | A | * | 5/1975 | Blad et al. | 428/60 |
| 4,474,536 | A | * | 10/1984 | Gougeon et al. | 416/226 |

(Continued)

FOREIGN PATENT DOCUMENTS

| | | |
|---|---|---|
| DE | 2543085 | 8/1976 |
| DE | 240227 | 10/1986 |
| DE | 20105223 | 8/2001 |

OTHER PUBLICATIONS

International Search Report for PCT/EP2008/008158, mailed Oct. 28, 2009.

(Continued)

*Primary Examiner* — Ryan Kwiecinski
(74) *Attorney, Agent, or Firm* — Nixon & Vanderhye P.C.

(57) ABSTRACT

A longitudinal connection is formed for wooden components and a corresponding wooden component. A fitting piece is glued in a recess to the outer or bottom sides of the at least two glued laminated girders to be connected in such a way that a scarf joint is created at least in a partial length of the fitting piece between the fitting piece and the respective glued laminated girder originating from the tapered and transition regions of the fitting piece in the direction of the end of the associated glued laminated girder.

30 Claims, 8 Drawing Sheets

(56) References Cited

U.S. PATENT DOCUMENTS

| | | | | |
|---|---|---|---|---|
| 4,848,053 | A * | 7/1989 | Clausen | 52/204.591 |
| 4,890,953 | A * | 1/1990 | Malatesta | 403/178 |
| 5,058,746 | A | 10/1991 | Morgan, IV | |
| 5,079,894 | A * | 1/1992 | Lau | 52/847 |
| 5,648,138 | A * | 7/1997 | Tingley | 428/105 |
| 5,650,210 | A * | 7/1997 | Fujii et al. | 428/57 |
| 5,651,154 | A * | 7/1997 | Ahlskog et al. | 14/6 |
| 6,318,046 | B1 * | 11/2001 | Horsfield et al. | 52/847 |
| 6,578,341 | B2 | 6/2003 | Hoffman et al. | |
| 7,870,628 | B2 * | 1/2011 | Reynolds | 14/4 |
| 8,409,396 | B2 * | 4/2013 | Bech et al. | 156/304.5 |
| 2002/0182361 | A1 * | 12/2002 | Hayakawa | 428/60 |
| 2007/0125448 | A1 * | 6/2007 | Abbott | 144/354 |
| 2010/0316458 | A1 * | 12/2010 | Lindgren et al. | 409/79 |

OTHER PUBLICATIONS

Written Opinion of the International Searching Authority for PCT/EP2008/010852, mailed Oct. 28, 2009.
DIN 1052 (Aug. 2004).
DIN EN 386 (Apr. 2002).
DIN EN 387 (Apr. 2002).
DIN EN 14080 (Sep. 2005).
Official Action dated Nov. 26, 2012, issued in corresponding Russian Patent Application No. 2010129853/03 (042439).
Karlsen, G. G., "Constructions of wood and plastic," 1975, Construction Publishing Bureau, Moscow, pp. 151-152.

* cited by examiner

METHOD FOR THE PRODUCTION OF A LONGITUDINAL CONNECTION FOR WOODEN COMPONENTS AND CORRESPONDING WOODEN COMPONENT

This application is the U.S. national phase of International Application No. PCT/EP2008/010852 filed Dec. 18, 2008 which designated the U.S. and claims priority to Germany patent application DE 10 2007 061 318.2 filed Dec. 19, 2007, the entire contents of each of which are hereby incorporated by reference.

The present invention relates to a method for the production of a longitudinal connection for wooden components and to a corresponding wooden component.

The solution according to the invention can conceivably be used in particular for a bonded wood-wood longitudinal butt joint for parallel flange girders, pitch roof girders, gable roof girders with a rectilinear or curved lower side, fish-bellied girders, truss girders or curved glued-laminated girders The invention is based on the technical and logistical problem that in structural wood glue construction, extensively stressed roof supporting frameworks with continuous glued-laminated girders are possible up to a length of 65 m, but the length of the individual components depends on the mechanical and spatial resources of the respective manufacturer.

Most manufacturers of glued-laminated timber for special components have production capabilities of from 24 m in length to a maximum of 35 m. Investment in longer production facilities and in the necessary buildings is for the most part uneconomical and impractical.

Unlike steel construction, the longitudinal butt joints in timber construction which are conventional according to the prior art are complex and for the most part uneconomical, because considerable cross-sectional weaknesses have to be considered in the static calculation. This entails significantly higher costs and corresponding competitive disadvantages.

A number of connection systems are known for the configuration of longitudinal butt joints of glued-laminated timber trusses, inter alia, for example with slotted sheets conventional in timber construction and pin-shaped metallic connecting means. In the meantime, a number of technically superior connection elements have also become known, which are adapted to the dimensions of the wooden components and are installed or glued, while countersunk into slots, holes or milled grooves.

The load-bearing wooden components can be bonded together, for example either through their scarf joint or through a universal dovetail joint. Corresponding calculations and dimensioning of wooden constructions can be inferred from DIN standard 1052, section 14. Countless industrial rights deal with problems of this type.

In DE 25 43 085 C2, a U-shaped steel part in the form of a bow with webs and arms offset in a chequered manner relative to one another is introduced into the grooves in a wooden construction girder such that the angled-off webs which project out of the abutting face are pushed one inside the other.

Furthermore, it is stated in prior publication DD 240 227 A1 which discloses a wooden roof girder with a universal dovetail joint, that steel or glass materials can be used to partially reinforce bonded glued-laminated wood.

In this respect, reference is also made to utility model DE 201 05 223 U1 which describes a butt joint of frame parts, in which contact surfaces of two wooden components are joined together. In this case, the butt joint is to be secured by at least one elongate second connecting means in the form of a plate-shaped reinforcing body. For this purpose, in the glued-laminated cross section in the region of the respective dovetail joint, a plate-shaped reinforcing body is glued into a groove made therein.

The configuration of longitudinal butt joints with slotted sheets is associated with a high cost and is therefore for the most part uneconomical. Apart from higher deformations and drying cracks, the efficiency, based on the load, is only approximately 50-60% of the unweakened wood cross section. Furthermore, additional wooden coverings or fireproofing coatings are necessary for fire protection requirements.

In the case of the universal dovetail joint according to DIN EN 387:2002-04, the cross-sectional weakenings on the base of the dovetail are to be considered in the dimensioning of said joint according to DIN 1052:2004-08. Without being verified more precisely, these should be assumed at 20% of the gross cross-sectional values, whereby the purely surface-related efficiency is a maximum of 80% of the gross cross section. Furthermore, due to the influence of knots in the region of the universal dovetail joint, the next lower strength class is to be respectively estimated in the dimensioning, which entails a further reduction in the efficiency of from 12% to 14%.

In a scarf joint according to DIN 1052 (2004-08), a bonding surface incline of at most 1/10 is to be observed. Thus, there results a scarf joint length of 20 m for a 2 m high load-bearing wooden component or a scarf joint length of 2.4 m for a 24 cm wide load-bearing wooden component. Thus, a scarf joint is largely uneconomical and can hardly be realised commercially in many cases.

Finally, a wooden connection is also known from U.S. Pat. No. 3,094,747 A.

According to this prior publication, two wooden parts to be joined together are provided on their mutually facing end sides with a smooth end face on which the two wooden girders are joined together abutting against one another. To realise a connection with the greatest possible strength, a recess which runs convexly over both end portions is made on two opposing sides, thus once in the bending tensile zone and once opposite in the bending pressure zone, in each case from the outside. A correspondingly convex shaped fitting piece is inserted from both opposing sides into this recess made convexly in the wooden material, seen in side view, whereupon the fitting piece can be pressed into the convex recesses using convex punches and bonded or glued, or fitting pieces are used which are preformed in a correspondingly convex manner. The protruding material portions can then be worked off at the two opposite outer sides of the wooden girders which are joined together, plane-parallel to the adjoining boundary wall of the joined wooden girders.

The fitting pieces to be incorporated can be made of any suitable material, for example of plastics material, metal, laminate, glass fibres or another material. The fitting pieces can also consist of timber or laminated wood.

However, it has been shown that even with a connection of this type, it is impossible to achieve degrees of efficiency which are significantly greater than those of a universal dovetail joint.

Therefore, the object of the invention is to avoid or basically reduce the disadvantages mentioned above and to provide an improved method for the production of a longitudinal connection for load-bearing and/or supporting wooden components as well as to provide a corresponding wooden component itself which, compared to the prior art, has a significantly higher load-bearing capacity.

It is very surprising that, in the context of the present invention, the efficiency of a butt joint can even be in the region of 90% to 100%, compared with the load of an unweakened wooden cross section, higher deformations based on the slippage of a connecting means being avoided.

This is realised according to the invention by a combination of various individual features. The invention preferably proceeds from the fact that the at least two wooden components to be joined together are connected by a universal dovetail joint in a connecting portion (i.e. in a partial thickness). However, relevant to the issue is in particular the use of a scarf joint which, in the following, will sometimes also be referred to as a scarf joint connection, in which a suitable fitting piece is inserted non-positively into a recess made in the wooden components to be connected, i.e. a fitting piece which is preferably made of wood is glued into the recess accordingly. In other words, the at least two wooden components to be connected each receive at their ends to be joined together—usually in the so-called bending tensile zone—a relief cut into which, depending on the required shape, a corresponding fitting piece is bonded after the two wooden components have been joined.

If the wooden components connected according to the invention are preferably used as a girder, it will generally be sufficient to only provide the corresponding scarf joint connection in the bending tensile zone, usually on the lower side of the girder. If there is a bending stress on the upper side of the girder, the mentioned fitting piece can also be bonded on the upper side of the connected wooden construction girders. If there is an alternating bending stress, it may be necessary to arrange the fitting piece on both sides. However, particularly when the connected wooden components are used as struts, it may optionally be sensible to provide an all-round arrangement of the fitting pieces, depending on the position of the component. This is particularly recommended if the struts can be exposed to very varied bending stresses, i.e. bending stress in very varied directions, or if differing bending stresses of this type can arise alternately.

The outer sides, in the bending tensile zone, of the wooden components to be connected (i.e. when a rather horizontally aligned girder is used, the underside of the wooden components), have in the region of the mentioned recess an incline which generally has a value of up to a maximum of 1/10. Particularly high bearing and loading forces are absorbed when the incline of the scarf joint has a value in particular of up to 1/10 or less. According to DIN standard DIN 1052, number 14.6, scarf joint connections are butt joints, with parallel running fibres, in wooden components with bonding surface inclines of at most 1/10.

However, in the context of the invention, it is quite possible to select the value of the scarf joint to be greater than the stated value of 1/10, for example up to 1/8, 1/6 or even 1/5 and more. It is relevant to the issue that the scarf joint, particularly starting from the merging end of the scarf joint (i.e. remote from the connecting joint of the two wooden components to be joined together) is to have as small a value as possible. In other words, the scarf joint should have as low an incline as possible starting from the merging end of the fitting piece over an adequate partial length of the fitting piece.

The geometry of the prefabricated fitting piece is preferably at least 1/6 of the height (or thickness) of the wooden component and half the length of the base of the fitting piece amounts to ten times the height of the fitting piece. The fitting piece itself can have different basic shapes. In a side view, it can be configured symmetrically or also asymmetrically. In a side view, it can be at least approximately triangular or somewhat trapezoidal. Particularly in the transition region, i.e. in the butt joint region of the two wooden components to be joined together at their end faces, the upper side of the fitting piece does not have to taper to a point, but can also run here in rounded-off form, parallel to the lower side etc. or even flattened obliquely to the lower edge.

In the context of the invention, it has proved to be particularly favourable to provide the fitting piece on its outer side (usually in the form of the lower side receiving the maximum bending tensile forces) with a high-strength premium lamella, preferably in the form of a high-strength premium board lamella. The glued-laminated girders can also be bonded with high-strength premium board lamellas on their bending tensile outer side to increase the loads to be absorbed. If required, a plurality of premium board lamellas can be joined together and joined to the glued-laminated girders. The use of a premium board lamella provides a greater strength in the region of the butt joint of the wooden components to be connected, which applies to a bending stress as well as to a tensile or pressure stress. In any case, a strength can thereby be achieved which is at least as high as and, in individual cases, is even higher than the strength of the un-jointed base material.

Finally, to achieve an additional reinforcement on the entire outside of the bending tensile zone, an additional reinforcing layer can be bonded on, for example, which can consist, for example of the materials used for the premium board lamellas.

The use of the solution according to the invention makes it possible to transport the load-bearing wooden components as short wooden construction girders and to be able to carry out the assembly or gluing which is required in situ on the construction site, for example while observing all the regulations according to DIN EN 14080 or DIN EN 387 (from 2002). This entails a significant reduction in the transportation costs and thus a substantial increase in the cost-effectiveness of extensively stressed wooden components. Compared with this, the additional cost for the curing, processing and bonding of the joint gluing is insignificant.

Thus, the production of continuous load-bearing and/or supporting wooden components as a truss is possible, in particular for manufacturers who do not have a relatively large manufacturing plant at their disposal.

This bonded longitudinal connection can be realised without diminishing the strength or the aesthetics compared to unweakened, un-jointed wooden components.

The invention provides an invention which is unique in timber construction for absorbing tensile forces in the joint area and which offers strengths above the strength of the base material. This unique connection is based on the use and the local application, proposed within the context of the invention, of wooden materials and wooden shapes in the critical region, thereby producing a very high strength and a rigidity which is comparable with that of the base material.

This is a fundamentally new development, compared with the solutions available hitherto. As a rule, up until now, materials of a very high strength (steel, 10 aramid fibres, carbon fibres . . . ) were always used to increase the strength of connections which materials, however, have substantially higher modules of elasticity compared to the wooden base material. The very high differences in rigidity between joint material and base material entail stress concentrations and stress peaks. The increase, regardless of the very high joint reinforcements, results in the premature fracture or delamination of the butt joint.

The strength is usually greatly reduced by knots and defects. The defects ultimately determine the strength classes. By using a virtually defect-free wooden material in the joint area, said joint area is reinforced in the reduced region such that the disturbance/reduction of the gross cross section inside the cross-sectional area of approximately ⅔ of the cross-sectional height is no longer significant.

In the following, the invention will be described in detail with reference to embodiments, illustrated schematically in the figures.

Figure 16:
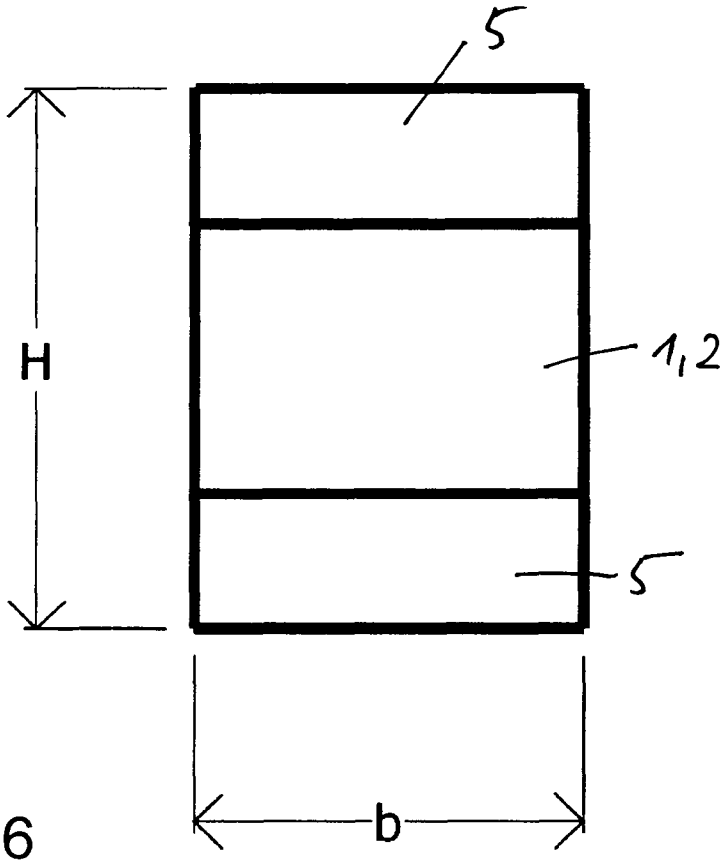
Figure 17:
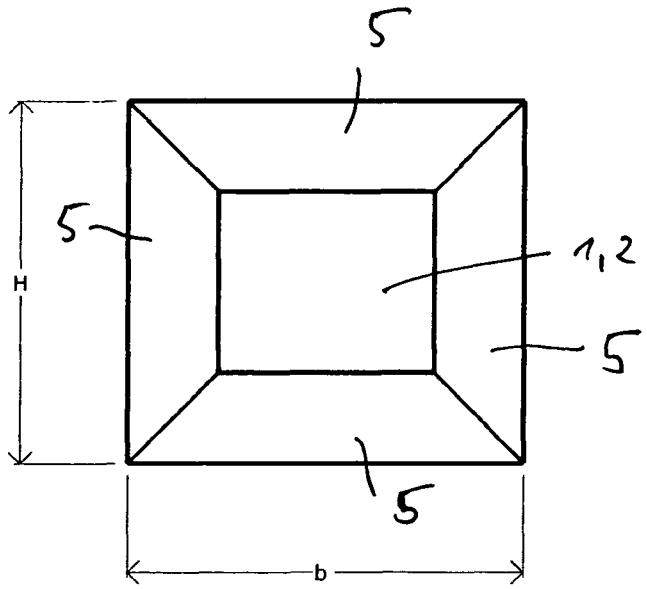

FIG. 16 is a cross-sectional view transversely to the longitudinal direction of two connected glued-laminated girders, for which recesses have been made on two opposite sides and a respective fitting piece has been glued therein; and FIG. 17 shows a modified embodiment compared to FIG. 16, in which a fitting piece 5 has been provided or glued on all four outer sides in the joint region of the glued-laminated girders 1, 2 to be connected.

Figure 1:
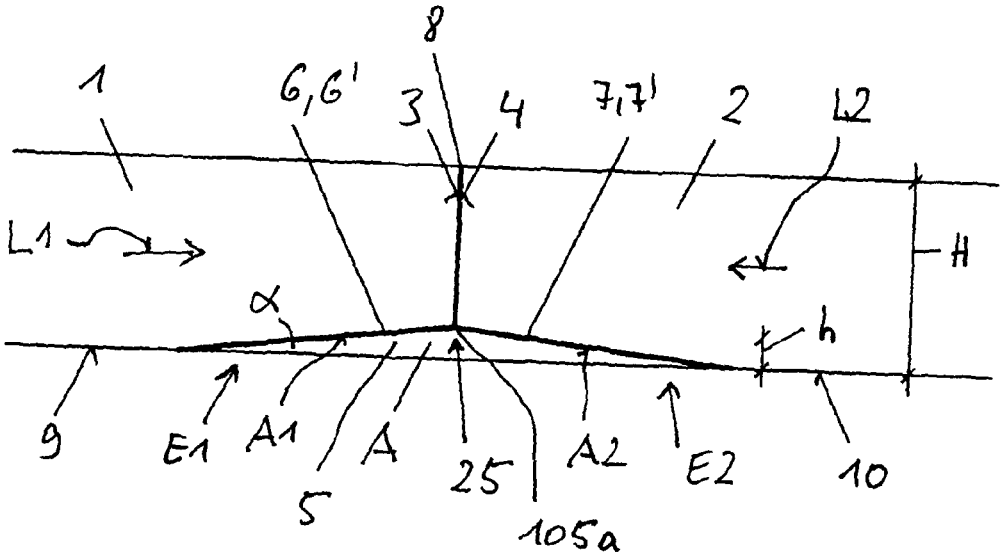
FIG. 1 is a longitudinal sectional view or side view of the longitudinal joint of a parallel flange girder with an inserted fitting piece.

In the following, the invention will be described on the basis of an embodiment, FIG. 1 showing a side view of a bonded longitudinal connection as a longitudinal butt joint of glued-laminated timber with a fitting piece scarfed in the bending tensile zone (i.e. with the bending tensile zone underneath in the vertical direction).

Figure 2:
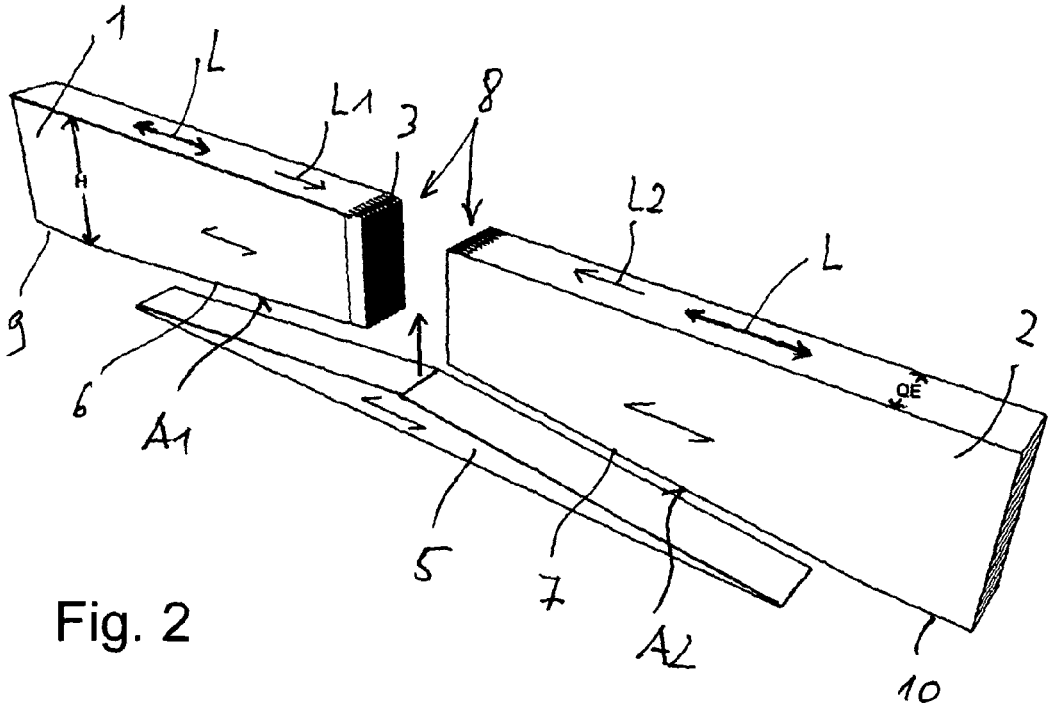
FIG. 2 is a spatial view of the embodiment according to FIG. 1 before assembly of the individual parts.

According to the embodiment of FIGS. 1 and 2, glued-laminated girders 1 and 2 are cut to size according to the figures and dovetail profiles 8 are milled as a universal dovetail joint into the ends 3 and 4, to be joined together, of the load-bearing wooden components. These dovetail profiles 8 are coated with glue or adhesive and the ends 3 and 4 of the two glued-laminated girders 1 and 2 are pressed together under longitudinal pressure according to the arrows L1 and L2.

With reference to FIG. 2, the ends 3, 4, to be connected, of the two glued-laminated girders 1, 2 with the recesses A1 and A2, already made, and the lower side thereof and the fitting piece 5 to be finally inserted there are indicated schematically in an extract, spatial view. It can also be seen that the rib-shaped dovetails preferably run in the vertical direction H, i.e. transversely to the outer side or lower side, on which the recesses A1 and A2 are made and into which the mentioned fitting piece is inserted.

According to the basic variant shown in FIGS. 1 and 2, the construction is such that in the region of the ends 3, 4, to be joined together, of the glued-laminated girders 1, 2, to be joined together, a respective separate recess A1 and A2 is to be made starting from the lower edge 9 (i.e. the outer side or lower side 9) of the glued-laminated wooden part 1 and starting from the lower edge 10 (i.e. the outer side or lower side 10) of the glued-laminated girder 2, more specifically with the formation of lower sides 6 and 7 which run obliquely towards one another. The lower sides 6 and 7 running obliquely towards one another of the glued-laminated girders 1 and 2 are to be produced as a smooth milling without a milled-in dovetail profile 8 and, in the joined state, produce a common recess A which, in the illustrated embodiment, is in the shape of an isosceles triangle. This common recess A is formed from the two separate recesses mentioned above which were made in the two end regions of the two glued-laminated girders 1, 2. Adapted to this isosceles triangle with the sides 6 and 7 is a separately prefabricated fitting piece 5 which is bonded to the lower sides 6 and 7 of the glued-laminated girders 1 and 2 under lateral pressure Q. The geometry of the fitting piece 5 is determined using the girder height H of the unweakened wooden component of the glued-laminated girders 1 and 2. The side height h of the fitting piece 5 is ≥H/6. The intersection angle usually has an incline of up to 1/10 according to the requirements of DIN 1052 (from 2004) for scarf joint connections. Therefore, the incline is the angle of the side height h of the fitting piece 5 (based on its lower base in FIG. 1 and the associated length of the fitting piece from the region of the butt joint 8 and the merging end E1 or E2). Since in the illustrated embodiment according to FIG. 1, the fitting piece is symmetrical to a vertical central plane of symmetry, the scarf joint angle of slope $\alpha$=h/half the length of the fitting piece 5. However, if required, the incline can also be steeper to some extent, i.e. it can assume values of up to 1/8, 1/6 or for example 1/5. The angle of inclination $\alpha$ of the scarf joint will, however, usually assume a value of at the most 1/10 and, if necessary, can even be lower so that the incline, as far as the building statics allow, is reduced even further. Thus, an efficient element as fitting piece 5 is arranged as a triangle in the highly stressed bending tensile zone of the butted glued-laminated girders 1 and 2. In this respect, in the illustrated embodiment the fitting piece 5 in the form of a scarf joint connection is glued into the recess A in the style of an isosceles triangle. The term "scarf joint connection" as used herein is understood, according to DIN 1052 (of August 2004), as meaning butt joints, with the fibres running in parallel, in wooden components with bonding surface inclines of at most 1/10. However, in the context of the present application, the term "scarf joint connection" is also understood as meaning bonding surface inclines of more than 1/10. The universal dovetail joint 8 arranged in the pressure zone and in the central cross-sectional region is mainly subject to compression and shear stress and thus does not result in any appreciable reduction in strength of the connection, although tensile forces which act on the remaining portion of the universal dovetail joint are also still effective in the tensile zone.

Due to the combination of universal dovetail joint 8 and scarf joint connection on the lower side 6 and 7, the longitudinal joint described here achieves the strengths of the undisturbed wood cross section. This wood/wood longitudinal joint can be configured or repeated for any number of glued-laminated girders 1 and 2 and thus makes it possible to produce load-bearing wooden components of any length.

Thus, a recess is to be made in each case at least on one outer side 6, 7 of the glued-laminated girder 1, 2 and this recess is to be filled by a prefabricated fitting piece 5, corresponding to the dimensions, such that the base thereof is flush with the lower edge 9, 10 of the glued-laminated girders 1, 2.

A financially favourable bonding operation is also possible on construction sites with corresponding technical equipment, while observing all the regulations according to DIN 1052 (2004), DIN EN 14080, DIN EN 386 and 387 (2002). Consequently, it is possible to make enormous savings in transportation costs on construction sites abroad.

The glued-laminated girders 1 and 2 are processed in an accurately fitting manner by CNC processing machines.

A corresponding illustration of the embodiment according to FIG. 1 is shown spatially in FIG. 2, more specifically with the two wooden components 1 and 2, not yet joined together, and the illustration of the fitting piece 5 to be inserted, provided spatially separated underneath. In this respect, the wooden components 1 and 2, to be connected, are usually processed before being joined together such that they are provided with the recesses A1 and A2. The fitting piece 5 is then connected to the two wooden components in a subsequent second step or in a combined step.

It can also be seen from the drawings that the transverse extent QE vertical to the longitudinal extent L and vertical to the height H of the glued-laminated girders 1, 2 to be connected corresponds to the appropriate measurement in the transverse extent direction with respect to the fitting piece 5 to be inserted, i.e. in the illustrated embodiment, the fitting piece 5 extends over the entire width or thickness of the glued-laminated girders 1, 2 to be connected. As mentioned, the fibre directions F both in the glued-laminated girders 1, 2 to be connected and in the fitting piece to be inserted are aligned such that they run at least approximately in the longitudinal direction L, i.e. they are preferably oriented in this direction.

Figure 3:
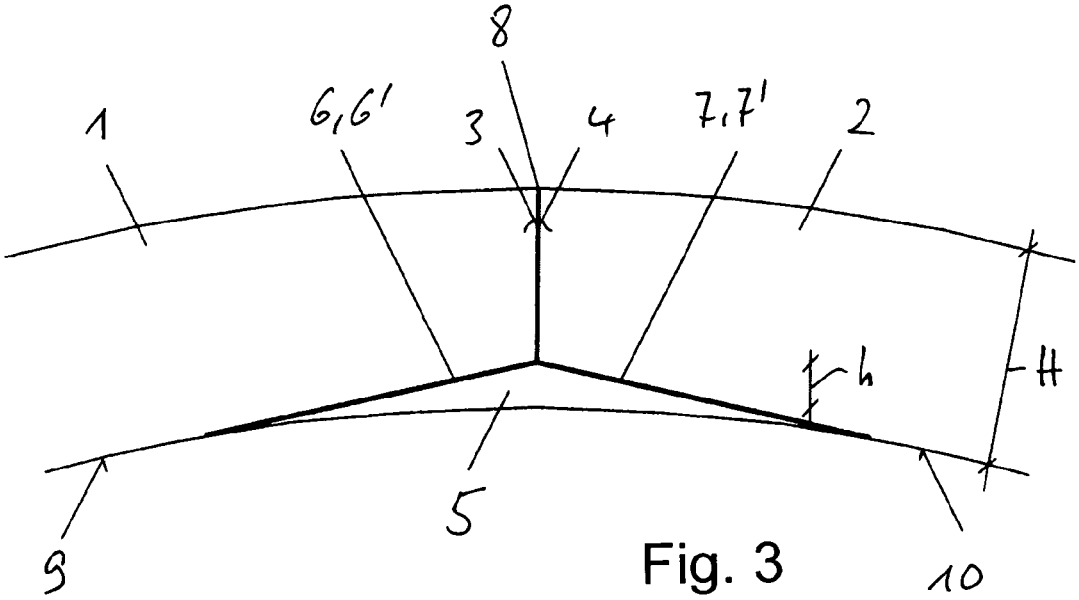
FIG. 3 is a modified view, compared to FIG. 1, of a longitudinal butt joint of a bowstring girder.
Figure 4:
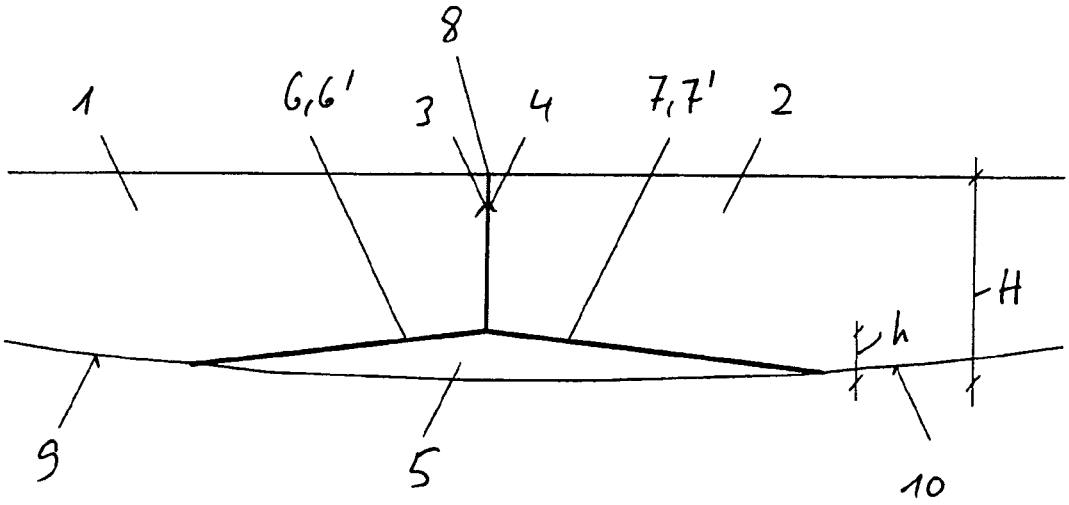
FIG. 4 is a schematic side view of a longitudinal butt joint of a fish-bellied girder.

With reference to FIGS. 3 and 4, two embodiments are shown which are modified with respect to the embodiment according to FIG. 1, the procedural method of the production of the longitudinal connection of the load-bearing components being carried out analogously to FIG. 1.

In this case, the fitting piece 5 is configured as a curved triangle and thus, according to FIG. 3 assumes a concave shape for the production of a bowstring girder or according to FIG. 4 assumes a convex shape for the production of a fish-bellied girder to respectively use this concave or convex fitting piece 5 on the lower side 6, 7 of the glued-laminated girders 1, 2.

If the height of the prefabricated fitting piece is less than ⅙, reductions in the static calculation are to be considered.

In the following, further embodiments will be described within the context of the invention.

In the following figures, schematic side and longitudinal sectional views similar to FIG. 1 are shown, although they differ from FIG. 1 with regard to the common recess A and/or the fitting piece 5 inserted therein.

Figure 5:
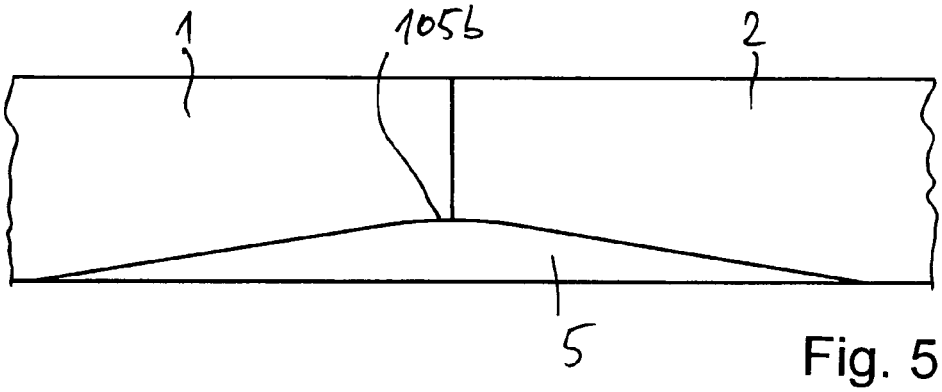
FIG. 5 is a side or longitudinal view, modified compared to FIG. 1, with an upper rounding on the inserted fitting piece.
Figure 6:
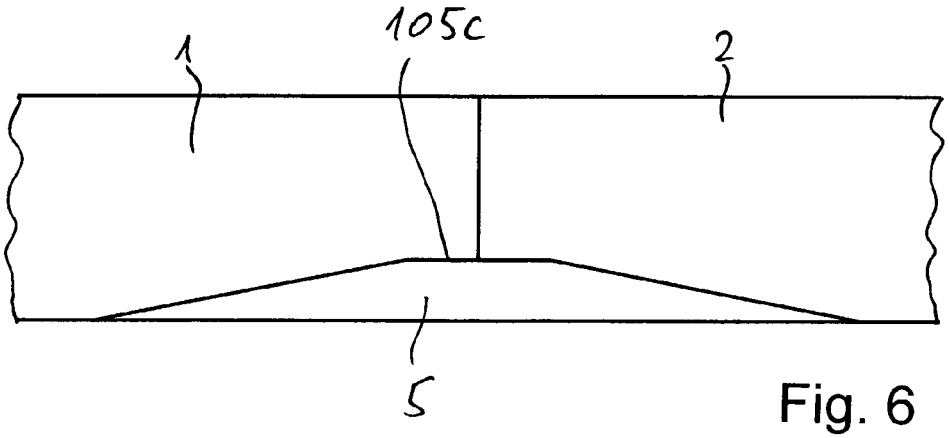
FIG. 6 is a view, modified compared to FIG. 5, with an upper planar plateau.
Figure 7:
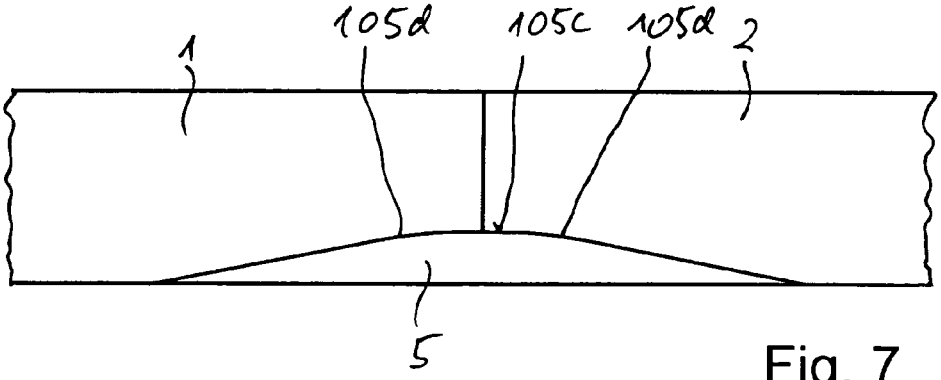
FIG. 7 is a view, again modified compared to FIG. 6, in which the upper planar plateau merges into the scarf joint connection by the rounding off of the edges.

On the basis of FIGS. 1 and 2, it has been explained that the fitting piece 5 merges in its triangular shape in its transition region 25 (i.e. where the two glued-laminated girders 1 and 2, to be connected, are joined together at their end faces) with a point 105*a* producing overall a triangular shape. FIG. 5, which is different to this, shows that this transition region 25 on the fitting piece 5 can be configured to be rounded off opposite its outer or lower side 5*a*, i.e. it can have a rounding 105*b*. FIG. 6 shows that the region of the fitting piece 5 merging at the top can be configured with a planar surface 105*c* which can run, for example parallel or obliquely to the lower edge or lower side 9 and 10 of the two glued-laminated girders 1, 2. The flattened area 105*c* can also merge in the transition region to the scarf joint connections 24 not angularly, but rather in a rounded manner (roundings 105*d*), as shown in FIG. 7.

The previous embodiments also show that the fitting piece is formed such that starting from a maximum height usually in the transition region 25, it becomes thinner and decreases in height towards its merging and transition region, remote in each case from the ends 3, 4 of the glued-laminated girders 1, 2 to be connected, according to the scarf joint incline (scarf angle $\alpha$). In this respect, the fitting piece 5 does not have to have a single highest point 105*a* or 105*b*, but can have more or less the same height in a central region which can amount to 10% to 60% of the total length of the fitting piece or less, for example 20% to 30% of the total length of the fitting piece 5, in order to only then run into the merging and transition region as pointedly as possible with a scarf joint incline of at the most 1/10 or preferably even less in order to produce here an optimum scarf joint connection with the adjoining glued-laminated girder 1, 2.

Therefore, the fitting piece 5 is glued into the recess A with the outer sides or lower sides 6, 7 of the at least two glued-laminated girders 1, 2, to be connected, by a scarf joint connection 6', 7' such that the scarf joint connection 6', 7' increases with a scarf incline which preferably has a value of up to a maximum of 1/10 at least in a partial length of the fitting piece between the fitting piece 5 and the respective glued-laminated girder 1, 2, starting from the merging and transition region E1, E2 of the fitting piece 5 in the direction of the end 3, 4 of the associated glued-laminated girder 1, 2.

The previous embodiments have each been shown for the case in which the fitting piece is configured symmetrically, vertical to the longitudinal direction of the connected glued-laminated girders 1, 2. However, the corresponding common recess A and the fitting piece 5 can also be asymmetrical, thus in a side view, unlike FIGS. 1 and 3 to 5, they do not have to be configured symmetrically when observed laterally.

Furthermore, the bonding surfaces 6' and 7' between the fitting piece 5 and the components 1, 2 can also be provided with a suitable profiling so that no loss of any kind or stress concentration occurs in the bonding surface.

However, in the context of the invention, a further increase in strength of the wooden connection can be realised. Pertinent examples are described in the following.

For this purpose, the fitting piece 5 is provided in the lower cross-sectional region up to the outer or lower edge 5*b* corresponding to the outer or lower side of the wooden components 1, 2 with a high-strength premium lamella 23 (see FIG. 8), in particular in the form of a premium board lamella 23. The glued-laminated girders 1, 2 also have, preferably in the lower cross-sectional region, high-strength premium lamellas 21, 22, also preferably in the form of high-strength premium board lamellas 21, 22, such that the transition between the glued-laminated girders 1, 2 and the fitting piece 5 is bonded without disturbance. If required, a plurality of premium board lamellas 21 to 23 can also be arranged in the lower cross-sectional region, which can also be advisable in particular to achieve high girder cross sections.

The entire fitting piece can be produced from softwood or hardwood, a wooden material or a material otherwise suitable for the application, so that a defect-free bonding is possible. The fitting piece can also consist of a suitable material and can be incorporated in solid or liquid form using a boarding. Furthermore, lateral reinforcements 29 can be provided which are indicated in dot-dash lines in the schematic side view in FIG. 8. These lateral reinforcements or reinforcing plates 29 can consist of veneered laminated wood, plywood or of another suitable material.

The premium lamella can preferably have a thickness (height) of from 30 mm to 60 mm, in particular from 40 mm to 45 mm. If the girders 1, 2 are curved, the lamellas can be significantly thinner, depending on the radius of curvature. Thus, the premium lamella and/or a reinforcing lamella to be discussed in the following can have a thickness of up to only 6 mm, for example.

On the other hand, the thickness of the premium lamella and/or the reinforcement lamella 28, discussed in the following, can also be between ⅙ to ¼ or ⅓, more specifically ±30%. In other words, the thickness could also be between ⅛ to ½, that is, in each case based on the height H of the fitting piece 5.

Figure 8:
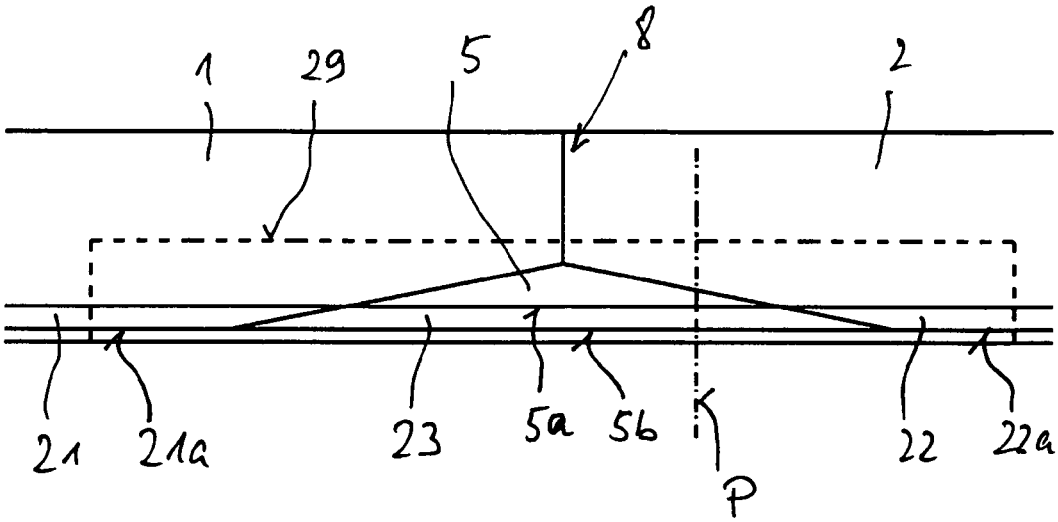
FIG. 8 is a schematic longitudinal side view or longitudinal cross-sectional view of an embodiment, modified again, using premium board lamellas and a further lamella-shaped reinforcement.

Furthermore, an additional reinforcing lamella 28 can be provided on the outer side or lower side of the wooden connection. In the embodiment according to FIG. 8, provided in addition to the premium board lamella 23 which has already been mentioned is a further reinforcing lamella 28 which jointly covers both the outer side 21*a* or lower side 22*a* of the two premium board lamellas 21 and 22 (in each case on the lower side of the two wooden components 1 and 2) as well as the premium board lamella 23 in the region of the fitting piece 5. In other words, this reinforcing lamella 28 can be provided depending on whether or not the mentioned premium board lamellas 21, 22 or 23 are provided on the wooden components 1 and 2 or on the fitting piece 5.

This mentioned additional reinforcing lamella 28 can be bonded in particular to the transition region from the fitting piece 5 to the respective glued-laminated girder 1, 2 or preferably over the entire girder length. This reinforcing lamella 28 can also consist of the same materials of which the premium board lamellas 21 to 23 are formed, which will be discussed in more detail in the following.

Figure 9:
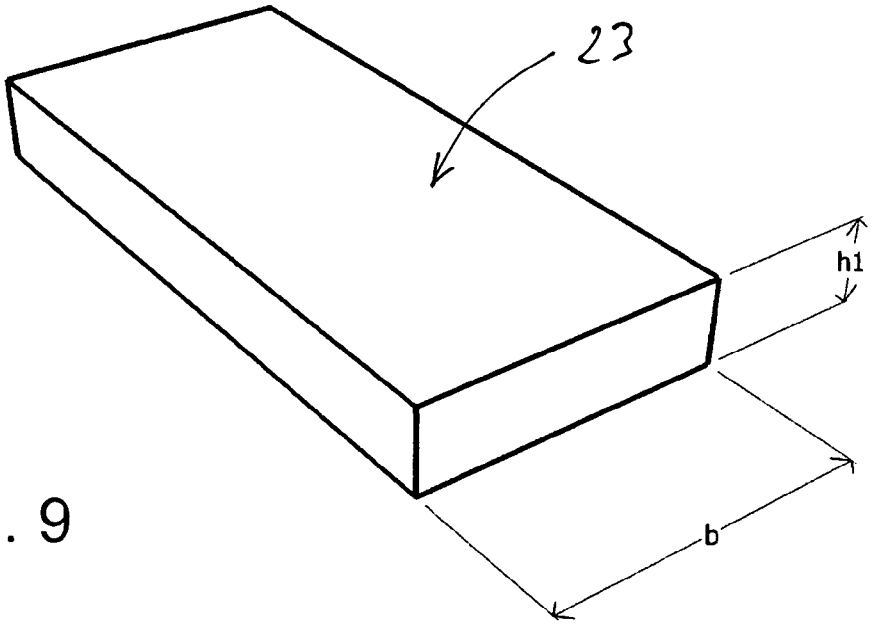
FIG. 9 is a spatial view of an individual defect-free board lamella.
Figure 10:
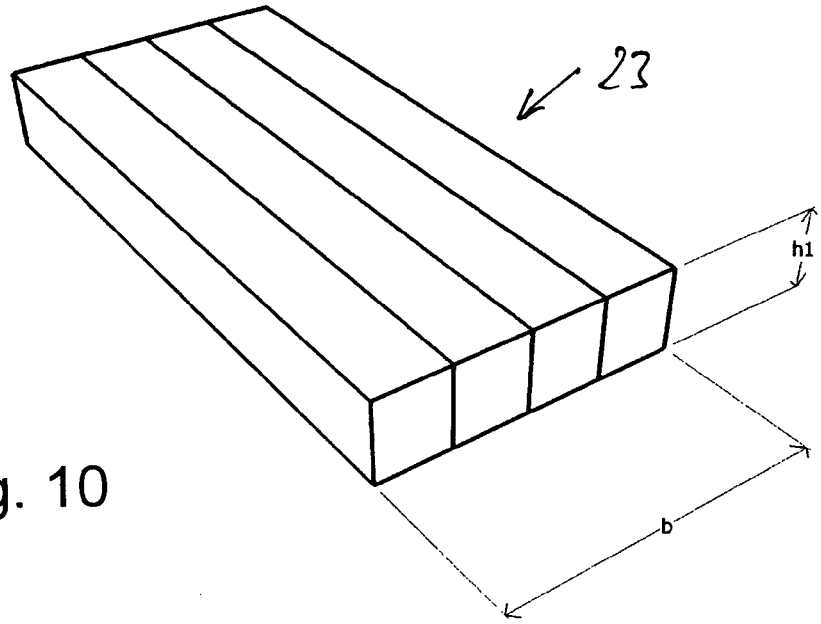
FIG. 10 is a spatial view of a hybrid lamella consisting of four adjacent individual lamellas.
Figure 11:
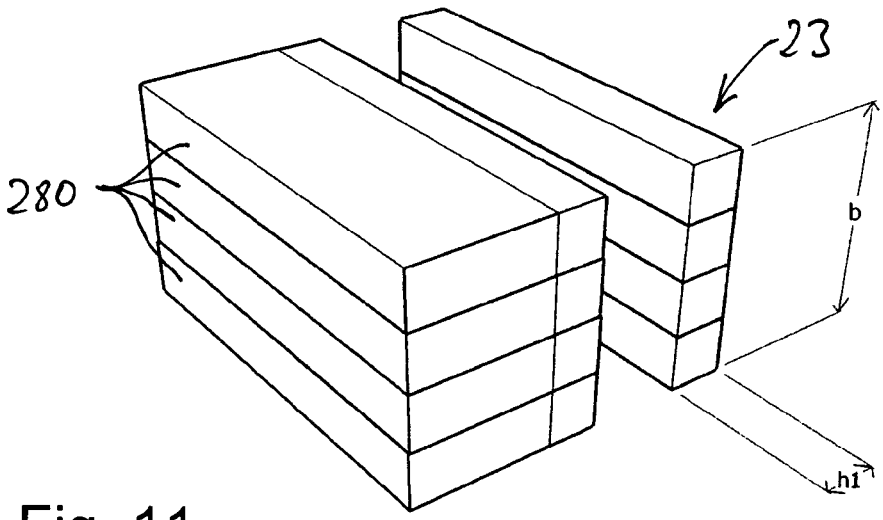
FIG. 11 is a spatial view to illustrate the production of a premium board lamella by means of separating cuts.
Figure 12:
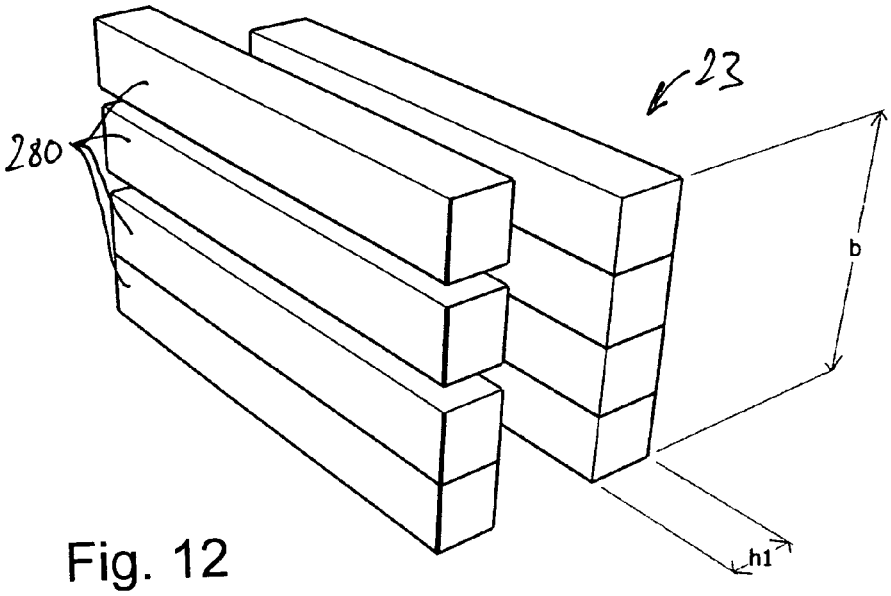
FIG. 12 is a further spatial view to illustrate the production of a premium board lamella which is glued together from a plurality of individual beam-shaped lamella portions.
Figure 13:
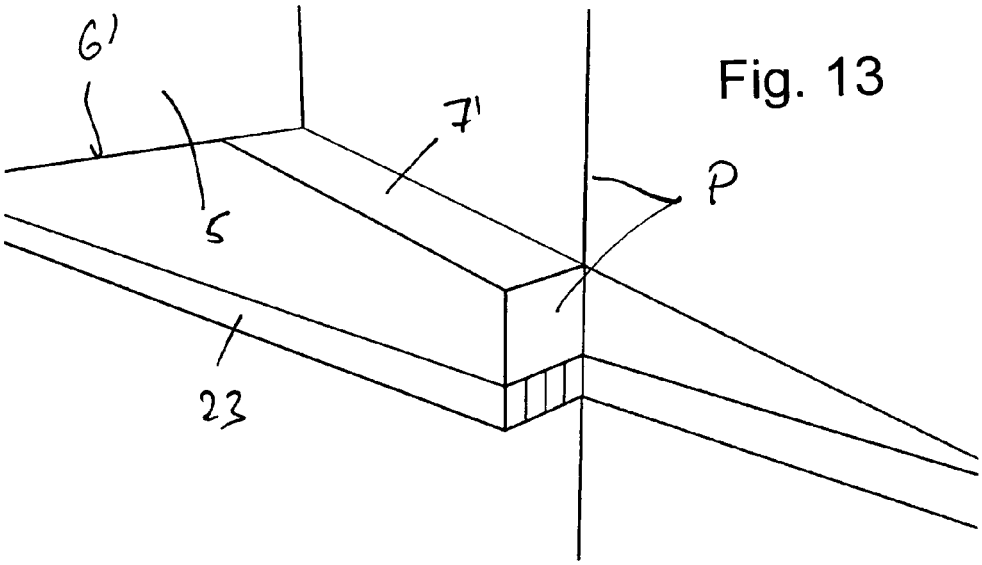
FIG. 13 is a spatial view of an extract of a fitting piece with a hybrid lamella, bonded to the lower or outer side (also only shown in part) and consisting of four individual lamellas.

The premium board lamella can consist of a blemish- or defect-free lamella with pin knots up to preferably 5 mm in diameter, as shown schematically in FIG. 9. However, the premium board lamellas can also be bonded together to form a hybrid board lamella from a plurality of members lying in parallel, as shown schematically in FIG. 10. These glued together board lamellas can be produced by separating a previously glued block (FIG. 11) or by gluing together individual squared timbers 280 (FIG. 12). The hybrid board lamella (FIG. 10) is to be produced from defect-free softwood, for example silver fir or common spruce, or from a hardwood. Care should be taken that the dovetails conditioned by production are adequately offset. Furthermore, hardwood or suitable wood materials, for example veneered laminated wood can also be used for the premium lamella. The hybrid lamella of FIG. 10 consisting of a plurality of individual lamellas is shown spatially in FIG. 13 in the connected state with the fitting piece 5, where a part of the front fitting piece 5 and of the hybrid lamella consisting of a plurality of individual lamellas has been omitted to illustrate the cutting plane P which can be seen there and the extended scarf joint 5' is indicated only with respect to the further lines continuing to the right. The cutting plane P which can be seen spatially in FIG. 13 is also shown in FIG. 8.

The mentioned premium lamella or the premium board lamella, but also the additional reinforcing lamella 28, if made of wood, are preferably produced such that the fibres in these lamellas are preferably oriented in the longitudinal direction L of the wooden components to be connected, at least approximately or at least with the greater component in the longitudinal then in the transverse direction.

In the following, the production of an improved transition between the fitting piece and the glued-laminated girders is described which, in the following, is also called a merging scarf region which is thus remote from the respective girder ends 3 and 4.

The scarf merging region E1, E2, i.e. the transition between the fitting piece 5 and the glued-laminated girders 1, 2 is preferably configured as a planar bond. The bond can be applied in the form of a lateral pressure Q with a defined pressing power. However, an unpressurised connection is also possible. The bond can also be configured as a screw press bond. Furthermore, the bond can be reinforced by the use of suitable screws. As an adhesive with a joint-filling characteristic, it is possible to use either polycondensation adhesives (phenol resorcinol formaldehyde, resorcinol formaldehyde) or polyaddition adhesives (epoxide, polyurethane, methacrylate).

Figure 14:
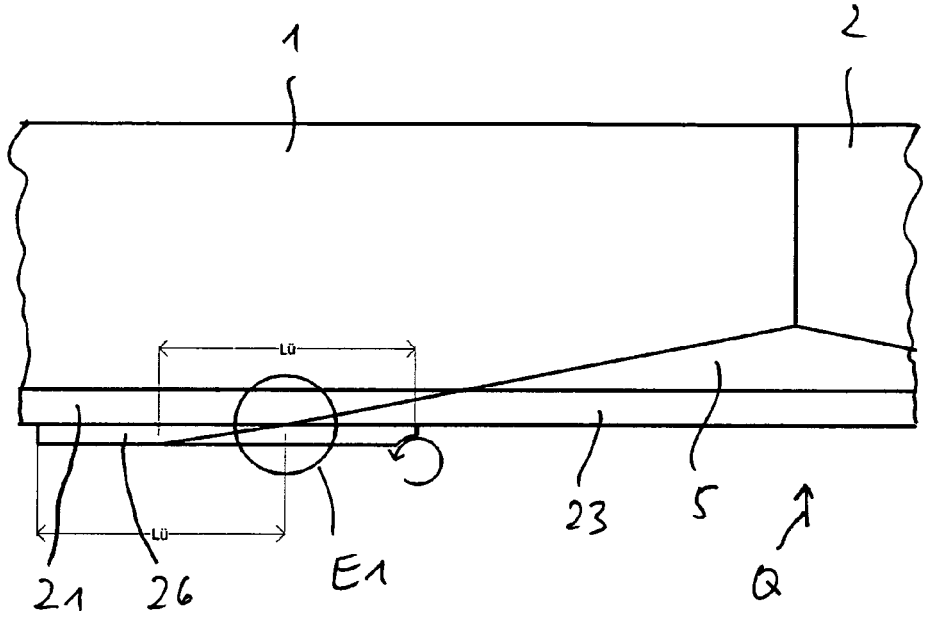
FIG. 14 is a schematic extract longitudinal or side view, illustrating the production of a particularly optimum transition or merging region between fitting piece and glued-laminated girder.

In order to achieve a disturbance-free bond in the scarf merging and/or transition region E1 and E2 between the glued-laminated girders 1, 2 and the fitting piece 5, an additional layer 26 (i.e. a lamella-type auxiliary layer preferably also made of wood) is preferably previously bonded on the respective processing side of the glued-laminated girders 1 and 2 and on the outer side or lower side 5*a* of the fitting piece 5, this additional layer 26 covering the immediate scarf merging end E1, E2 (FIG. 14). This additional layer 26 can consist of softwood, hardwood or a wood material and is to be bonded onto the respective outer side 9, 10 in a length of Lü. When bonding is complete, the additional layer is to be removed as far as the lower edge of the girder by planing, sawing or milling.

The use of the additional layer 26 to produce a particularly optimal connection between the fitting piece 5 and the glued-laminated girders 1 and 2 in the lower merging and/or transition region E1 and E2 also applies if the mentioned premium board lamella 23 or 21 has been bonded to the lower side 5*a* of the fitting piece 5 and/or to the lower side 9 and 10 of the glued-laminated girders. At the transition of the premium board lamellas, a full-surface connection which is as optimal as possible is also to be produced at the merging end, formed there, between fitting piece and wooden components, because it is here that the greatest bending tensile forces arise.

Figure 15:
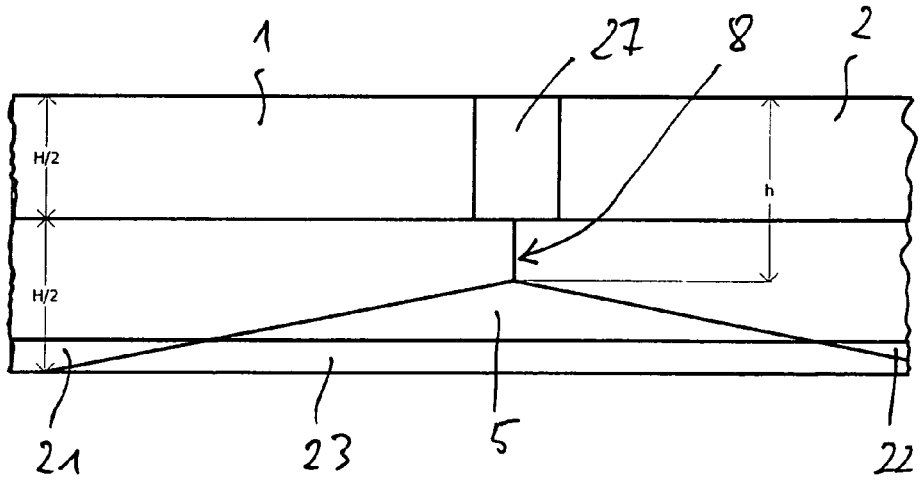
FIG. 15 is a schematic longitudinal sectional or side view of a modified embodiment, using a pressure block on the bending pressure side of the wooden connection.

The embodiments which have been explained have been clarified for the case in which the respective girder ends 3, 4 of the glued-laminated girders to be connected are joined together by a universal dovetail joint 8 above the fitting piece 5. Where there is an alternating bending stress which is to be eliminated, the longitudinal butt joint can, however, be configured differently in the bending pressure region from the previously described embodiments, i.e. differently from the bending tensile region. With a bending pressure stress in the upper region of the cross section, the previous description provides a universal dovetail joint. The transition between the glued-laminated girders 1, 2 can be eliminated in the upper half of the girder height from the girder upper edge to zero fibres, such that a form-locking pressure block 27 can be used by means of a screw connection and shrinkage-free filling compound or mortar, as shown in a schematic longitudinal sectional view in FIG. 15. The pressure block is to be selected from a suitable compression-proof material and can be screwed in or poured in, in liquid form, using a boarding.

FIG. 16 shows a cross section vertical to the longitudinal direction L of the connected glued-laminated girders 1, 2, a corresponding cross section through the fitting piece 5 being indicated below. This embodiment relates to the case in which, due to alternating bending tensile stresses, a corresponding construction is not only provided on the lower outer side of the glued-laminated girders, but corresponding recesses are also provided on the opposite side, located above in FIG. 16. In other words, a corresponding connection or fitting of a further fitting piece is additionally provided on the upper outer side of the glued-laminated girders 1, 2, such that a construction of this type is particularly suitable when the wooden components, connected thus, are used as a vertically oriented strut, for example, which is subject to an alternating bending tensile stress and bending compression stress on both opposing sides.

The corresponding cross-sectional view according to FIG. 17 only additionally illustrates the case in which two glued-laminated girders 1, 2 are connected together at their ends 3, 4 in the longitudinal direction L, and in this embodiment, a corresponding recess, as explained with reference to the other embodiments, is respectively made in all four outer sides and a fitting piece is glued in or cured at the corresponding scarf angle. In this case, the fitting pieces must be tapered on their rather triangular or trapezoidal side regions to the centre of the wooden connection, since with a square or rectangular cross section of the glued-laminated girders 1, 2 to be connected, each fitting piece is respectively connected on its side boundary 5*c* with the corresponding side of the next fitting piece which is rotated by 90° and is also preferably bonded here with this side surface of the next adjacent fitting piece.

In summary, it can be established that the technology herein is further characterized by a number of advantageous embodiments, for example as characterized by the following features, either alone or in combination, namely in that:

the fitting piece 5 which consists of wood is bonded in the recess with the lower sides 6, 7 of the at least two glued-laminated girders 1, 2 to be connected by a scarf joint which preferably has an inclination value of a maximum of ⅕, preferably up to a maximum of ⅙, ⅛ or preferably up to a maximum of 1/10;

the common recess A is bonded positively with a fitting piece 5 preferably made of wood or, using a flowable and/or formable material, optionally using a boarding, the fitting piece is introduced into the recess A with the formation and/or curing of the fitting piece 5;

a prefabricated fitting piece 5 is used, the height of which is at least ⅙ of the height of the glued-laminated girders 1, 2;

after the glued-laminated girders 1, 2 have been connected, the recess A resulting thereby is filled by a fitting piece 5 such that the base of the fitting piece 5 terminates flush with the lower side 9, 10 of the glued-laminated girders 1, 2;

the recesses A1, A2 to be made in the ends 3, 4, to be connected, of the glued-laminated girders 1, 2, to be connected, are formed such that when the glued-laminated girders 1, 2 are joined together, a triangle or trapezium is at least approximately produced as a common recess A, more specifically in a plane of symmetry oriented transversely to the longitudinal direction of the glued-laminated girders 1, 2 to be connected;

the premium board lamella 23 is connected to the adjoining premium lamella 21, 23 bonded on the outer side or lower side 9, 10 of the adjoining glued-laminated girder 1, 2, on the lower side or outer side 5*a* of the fitting piece 5, by means of a scarf joint preferably with an incline of up to a maximum of 1/10;

a reinforcing lamella 28 is attached, preferably bonded, preferably to the lower side 5*a* of the fitting piece 5 and to the lower sides 9, 10 of the glued-laminated girders 1, 2 or to the premium board lamellas 23, 21, 22 which are connected and bonded therewith;

a premium board lamella 23, 21, 22 and/or a reinforcing lamella 28 is used which, when the glued-laminated girders 1, 2 are curved in a side view, have a thickness of up to 6 mm and when the glued-laminated girders 1, 2 run straight in a side view, have a thickness of preferably 30 mm to 60 mm, in particular 40 mm to 45 mm;

a premium board lamella 23, 21, 22 and/or a reinforcing lamella 28 is used, the thickness of which preferably corresponds to ⅛ to ½, preferably ⅙ to ⅓ of the height of the fitting piece;

on the opposite side to the fitting piece 5, a form-locking pressure block 5 is worked in, preferably above the neutral pressure/tensile zone between the ends 3, 4, to be connected, of the glued-laminated girders 1, 2, and is preferably inserted, screwed, bonded or poured in by means of a boarding using flowable and/or curable materials;

a fitting piece 5 is used or formed which has a thickness dimension or cross dimension QE which corresponds to the cross dimension or thickness dimension QE of the glued-laminated girders 1, 2 to be connected;

the two glued-laminated girders 1, 2 are bonded with the fitting piece 5 on their lower sides 6, 7 in the region of the entire recess A by a scarf joint;

the fitting piece 5 consists of a prefabricated fitting piece 5, preferably made of wood or a fitting piece 5 produced using workable and/or flowable and curable material, optionally by means of a boarding;

the base of the fitting piece 5 terminates flush with the lower side of the glued-laminated girders 1, 2;

an additional reinforcing lamella 28 is attached or bonded, preferably in the form of a high-strength reinforcing lamella 28 on the lower side or outer side 5*a*, 9, 10 of the fitting piece 5 or of the connected glued-laminated girders 1, 2 or to the premium lamellas 23, 21, 22 initially fitted there;

the premium board lamella 23 is connected to the lower side and/or outer side 5*a* of the fitting piece 5 and the premium board lamellas 21, 22 are connected to the lower side and/or outer side 9, 10 by a scarf joint;

the premium lamella 23, 21, 22 and/or the reinforcing lamella 28 have a thickness of up to 6 mm in a side view when the glued-laminated girders 1, 2 are curved, and have a thickness of preferably 30 mm to 60 mm, in particular 40 mm to 45 mm when the glued-aminated girders 1, 2 run straight in a side view;

a premium lamella 23, 21, 22 and/or a reinforcing lamella 28 have a thickness of ⅛ to ½, preferably ⅙ to ⅓ of the height of the fitting piece 5;

the fitting piece 5 and/or the at least one premium board lamella 23, 21, 22 and/or the reinforcing lamella 28 can consist of a wood material, in particular of preferably defect-free softwood and deciduous wood or hardwood or veneered laminated wood or can comprise these materials.

The invention claimed is:

1. Load-bearing wooden component comprising:

at least two glued-laminated girders joined together end-to-end with a partial-thickness dovetail joint, each of the at least two joined together glued-laminated girders having a respective separate recess on at least one side, the respective separate recesses together forming a common recess, a fitting piece provided in the common recess and positively connected to each of the at least two glued-laminated girders, the at least two glued-laminated girders being bonded with the fitting piece on their at least one side in the region of the provided common recess by a scarf joint, the scarf joint extending at an angle of inclination (a) at least in a partial length of the fitting piece starting from a merging and transition region of the fitting piece in the direction of an end of the associated glued-laminated girder, and a lamella firmly adhesively bonded to at least one of the fitting piece and the glued-laminated girders adjacent to the common recess, the lamella providing strength against both bending and tensile stresses to the component, the lamella comprising a hybrid board lamella formed of a plurality of parallelly glued-together members, wherein the at least two glued-laminated girders have widths and the plurality of glued-together members are arranged adjacently parallel to one another across the widths of the girders such that the plurality of parallelly glued-together members arranged side-by-side span the girder widths.

2. Wooden component according to claim 1, wherein the slope of the incline of the scarf joint has a value up to a maximum of 1/5.

3. Wooden component according to claim 1, wherein the fitting piece has a height which amounts to at least 1/6 of the height of the glued-laminated girders.

4. Wooden component according to claim 1, wherein the fitting piece has a lower side opposite the scarf joint which has at least one of a straight portion, a concave portion and a convex portion.

5. Wooden component according claim 1, wherein the common recess has the shape of a triangle.

6. Wooden component according to claim 5 wherein the triangle has rounded-off transitions.

7. Wooden component according to claim 1, wherein the glued-laminated girders have a fiber direction which runs longitudinally thereto.

8. Wooden component according to claim 1, wherein the lamella comprises a plurality of block-shaped individual lamellas which are rigidly interconnected and are bonded together.

9. Wooden component according to claim 1, wherein a lateral reinforcement comprising a wood material is bonded to a side of the glued-laminated girders.

10. Wooden component according to claim 1, further comprising a pressure block which consists of non-compressive material that, is fixed to the connected glued-laminated girders on a side thereof opposite the fitting piece above a central neutral pressure-tensile zone.

11. Wooden component according to claim 1, wherein the slope of incline of the scarf joint has a value up to a maximum of 1/6.

12. Wooden component according to claim 1, wherein the slope of incline of the scarf joint has a value up to a maximum of 1/8.

13. Wooden component according to claim 1, wherein the slope of incline of the scarf joint has a value up to a maximum of 1/10.

14. The wooden component of claim 1 wherein the lamella comprises fibers oriented in a direction other than transverse relative to the girders.

15. The wooden component of claim 1 further including additional auxiliary layers prebonded to the glue-laminated girders and the fitting piece, the additional auxiliary layers enabling full-surface connection between the fitting piece and the glue-laminated girders in a transition region, the auxiliary layers being configured to be removed when bonding is complete.

16. Load-bearing wooden component comprising:

first and second glued-laminated girders joined together end-to-end with a partial-thickness dovetail joint, the first glued-laminated girder having an outer surface having a first recess defined therein, the second glued-laminated girder having an outer surface having a second recess defined therein, the first and second recesses of the first and second joined-together glued-laminated girders together forming a common recess;

a fitting piece disposed in the common recess formed by the first and second recesses, the fitting piece positively connected and bonded by a scarf joint to the first and second glued-laminated girders, the scarf joint extending at an angle of inclination (a) at least in a partial length of the fitting piece starting from a merging and transition region of the fitting piece in the direction of an end of the first glued-laminated girder, and a lamella firmly adhesively bonded to at least one of the fitting piece and/of the glued-laminated girders adjacent to the common recess, the lamella providing strength against both bending and tensile stresses to the component, the lamella comprising a hybrid board lamella formed of a plurality of parallelly-glued together wood members.

17. Wooden component according to claim 16, wherein the slope of the incline of the scarf joint has a value up to a maximum of 1/5.

18. Wooden component according to claim 16, wherein the slope of incline of the scarf joint has a value up to a maximum of 1/6.

19. Wooden component according to claim 16, wherein the slope of incline of the scarf joint has a value up to a maximum of 1/8.

20. Wooden component according to claim 16, wherein the slope of incline of the scarf joint has a value up to a maximum of 1/10.

21. Wooden component according to claim 16, wherein the fitting piece has a height which amounts to at least 1/6 of a height of the glued-laminated girders.

22. Wooden component according to claim 16, wherein the fitting piece has a lower side opposite the scarf joint which has at least one of a straight portion, a concave portion and a convex portion.

23. Wooden component according claim 16, wherein the common recess has the shape of a triangle.

24. Wooden component according to claim 23 wherein the triangle has rounded-off transitions.

25. Wooden component according to claim 16, wherein the glued-laminated girders have a fiber direction which runs longitudinally thereto.

26. Wooden component according to claim 16, wherein the lamella comprises a plurality of block-shaped individual lamellas which are rigidly interconnected and are bonded together.

27. Wooden component according to claim 16, further comprising a lateral reinforcement comprising a wood material bonded to a side of the glued-laminated girders.

28. Wooden component according to claim 16, further comprising a pressure block which consists of non-compressive material that is fixed to the connected glued-laminated girders on a side thereof opposite the fitting piece above a central neutral pressure-tensile zone.

29. Load-bearing wooden component comprising:

at least two glued-laminated girders joined together end-to-end with a partial-thickness dovetail joint, each of the at least two joined together glued-laminated girders having a respective separate recess on at least one side, the respective separate recesses together forming a common recess, a fitting piece provided in the common recess and positively connected to each of the at least two glued-laminated girders, the at least two glued-laminated girders being bonded with the fitting piece on their at least one side in the region of the provided common recess by a scarf joint, the scarf joint extending at an angle of inclination ($\alpha$) at least in a partial length of the fitting piece starting from a merging and transition region of the fitting piece in the direction of an end of the associated glued-laminated girder, and a lamella firmly adhesively bonded to at least one of the fitting piece and the glued-laminated girders adjacent to the common recess, the lamella providing strength against both bending and tensile stresses to the component, the lamella comprising a hybrid board lamella formed of a plurality of parallelly glued-together members, wherein the plurality of members comprise wood.

30. Load-bearing wooden component comprising:

at least two glued-laminated girders joined together end-to-end with a partial-thickness dovetail joint, each of the at least two joined together glued-laminated girders having a respective separate recess on at least one side, the respective separate recesses together forming a common recess, a fitting piece provided in the common recess and positively connected to each of the at least two glued-laminated girders, the at least two glued-laminated girders being bonded with the fitting piece on their at least one side in the region of the provided common recess by a scarf joint, the scarf joint extending at an angle of inclination ($\alpha$) at least in a partial length of the fitting piece starting from a merging and transition region of the fitting piece in the direction of an end of the associated glued-laminated girder, and a lamella firmly adhesively bonded to at least one of the fitting piece and the glued-laminated girders adjacent to the common recess, the lamella providing strength against both bending and tensile stresses to the component, the lamella comprising a hybrid board lamella formed of a plurality of parallelly glued-together members, wherein the hybrid board lamella includes offsetted dovetails.

* * * * *